US008619000B2

(12) United States Patent
Shinkawa

(10) Patent No.: US 8,619,000 B2
(45) Date of Patent: Dec. 31, 2013

(54) ANTENNA DEVICE

(75) Inventor: Tomohiro Shinkawa, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 586 days.

(21) Appl. No.: 12/891,988

(22) Filed: Sep. 28, 2010

(65) Prior Publication Data

US 2011/0074648 A1 Mar. 31, 2011

(30) Foreign Application Priority Data

Sep. 30, 2009 (JP) ..... 2009-227325

(51) Int. Cl.
*H01Q 1/48* (2006.01)

(52) U.S. Cl.
USPC ..... 343/848; 343/700; 343/702; 343/725

(58) Field of Classification Search
USPC ..... 343/848
See application file for complete search history.

(56) References Cited

U.S. PATENT DOCUMENTS 4,924,237 A * 5/1990 Honda et al. ..... 343/702
5,426,439 A * 6/1995 Grossman ..... 343/727
8,094,088 B2 * 1/2012 Shinkawa et al. ..... 343/895

FOREIGN PATENT DOCUMENTS

JP 2003-87030 A 3/2003

OTHER PUBLICATIONS

Dalia Mohammed Nashaat, Hala A. Elsadek, and Hani Ghali, Single Feed Compact Quad-Band PIFA Antenna for Wireless Communication Applications, Aug. 2005, IEEE Transactions on Antennas and Propagation, vol. 53, No. 3, pp. 2631-2635.*

* cited by examiner

*Primary Examiner* — Jerome Jackson, Jr.
*Assistant Examiner* — Hai Tran
(74) *Attorney, Agent, or Firm* — Holtz, Holtz, Goodman & Chick, PC

(57) ABSTRACT

An antenna device includes a ground section including a planar section, a feeding section, a first feeding element arranged along the planar section of the ground section, and a second feeding element including a loop-like body portion arranged parallel to the first feeding element at a predetermined distance from the first feeding element, the loop-like body portion including one end portion bent to be electrically connected to the ground section, and the other end portion bent to be electrically connected to the feeding section. Both of the one end portion and the other end portion of the second feeding element are provided in a vicinity of an outer periphery of the ground section.

7 Claims, 7 Drawing Sheets

ANTENNA DEVICE

BACKGROUND OF THE INVENTION

1. Field of the Invention

The present invention relates to an antenna device.

2. Description of Related Art

An antenna device may take various shapes according to various factors, such as a frequency of a radio wave to be transmitted/received, an existence of directivity of the radio wave, and an installation location of the antenna device.

For example, as a form of a non-directional antenna device to be installed on a transportation machine such as an automobile, there is an external installation antenna device. The external installation antenna device is installed so that an antenna element is exposed to the outside (the outside of the transportation machine). In the following, an automobile is cited as an example of the transportation machine, and an antenna device to be installed in the automobile is described.

As an external installation antenna device, for example, the antenna device described in Japanese Patent Application Laid-Open Publication No. 2003-87030 may be cited. The antenna device described in Japanese Patent Application Laid-Open Publication No. 2003-87030 is a mast antenna as shown in FIG. 7.

The external installation antenna device such as the one disclosed in Japanese Patent Application Laid-Open Publication No. 2003-87030 involves several problems. For example, the antenna element exposed to the outside of an automobile is sometimes removed to be stolen by somebody. In addition, the antenna element exposed to the outside of an automobile sometimes mars a beauty of an outer appearance of the automobile.

In contrast, if the antenna device is installed in the inside of the automobile, the antenna element is not exposed to the outside. Consequently, it becomes extremely difficult to remove the antenna device from the outside of the automobile, and then a risk of being stolen is extremely reduced. Moreover, because the antenna element is not exposed to the outside, the beauty of the outer appearance of the automobile is not marred.

However, if the antenna device is installed in the inside of an automobile, problems different from those of the external installation antenna device can be produced. Hereinafter an antenna installed in the inside of an automobile is referred to as "internal antenna device" at the time of describing the details of the problems.

Not only the internal antenna device but a general antenna device needs a ground pattern having an area depending on a wavelength of a radio wave in order to stabilize properties of the antenna device sufficiently. On the other hand, because a space in the automobile is limited, an installation space of the internal antenna device is also within a limited range. Consequently, if the installation space of the internal antenna device is insufficient for the area of the ground pattern which depends on the frequency of the radio wave, it is impossible to provide in the antenna device the ground pattern which has the area depending on the wavelength of the radio wave.

If the ground pattern which has the area depending on the wavelength of the radio wave cannot be provided, an electric current (hereinafter referred to as "leakage current") leaking into an outer conductor (for example, a cable or the like) provided to extend from the antenna device becomes large. If the leakage current becomes large, the properties of the antenna device sometimes become unstable owing to a length and/or a drawing-around of a cable (coaxial cable) connected to the antenna device, and the antenna device cannot sometimes get a sufficient gain.

Thus, the internal antenna device involves the problem that the antenna device cannot sometimes obtain a sufficient gain because the installation space of the internal antenna device cannot sufficiently be secured.

The leakage current becomes larger as the area of the ground pattern becomes smaller. In other words, the more antenna device is miniaturized, the larger leakage current becomes. As result, the properties of the antenna device become unstable, and thereby the gain of the antenna device is lowered.

On the other hand, when trying to provide a ground pattern having a sufficient area in order to stabilize the properties of the antenna device, a size of the antenna device enlarges. In this case, the installation space of the internal antenna device needs to be provided according to the enlarged size of the antenna device, and this sometimes limits a design of the automobile. In addition, because the mast antenna such as the antenna device described in Japanese Patent Application Laid-Open Publication No. 2003-87030 has the long straight antenna element, providing the mast antenna in the inside of the automobile is sometimes difficult, and the design of the automobile would be limited by necessity of arranging the antenna element.

Moreover, non-directivity is required for the antenna device installed in the transportation machine in order to secure a good reception performance independent of a positional angle of the transportation machine.

SUMMARY OF THE INVENTION

It is an object of the present invention to achieve all of a miniaturization of the antenna device, an obtainment of a high gain, and non-directivity of the antenna device.

In order to achieve the above object, there is provided an antenna device including: a ground section including a planar section; a feeding section; a first feeding element arranged along the planar section of the ground section; and a second feeding element including a loop-like body portion arranged parallel to the first feeding element at a predetermined distance from the first feeding element, the loop-like body portion including one end portion bent to be electrically connected to the ground section, and the other end portion bent to be electrically connected to the feeding section, wherein both of the one end portion and the other end portion of the second feeding element are provided in a vicinity of an outer periphery of the ground section.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein.

DETAILED DESCRIPTION OF THE INVENTION

In the following, examples of embodiments of the present invention will be described in detail with reference to accompanying drawings.

Figure 1:
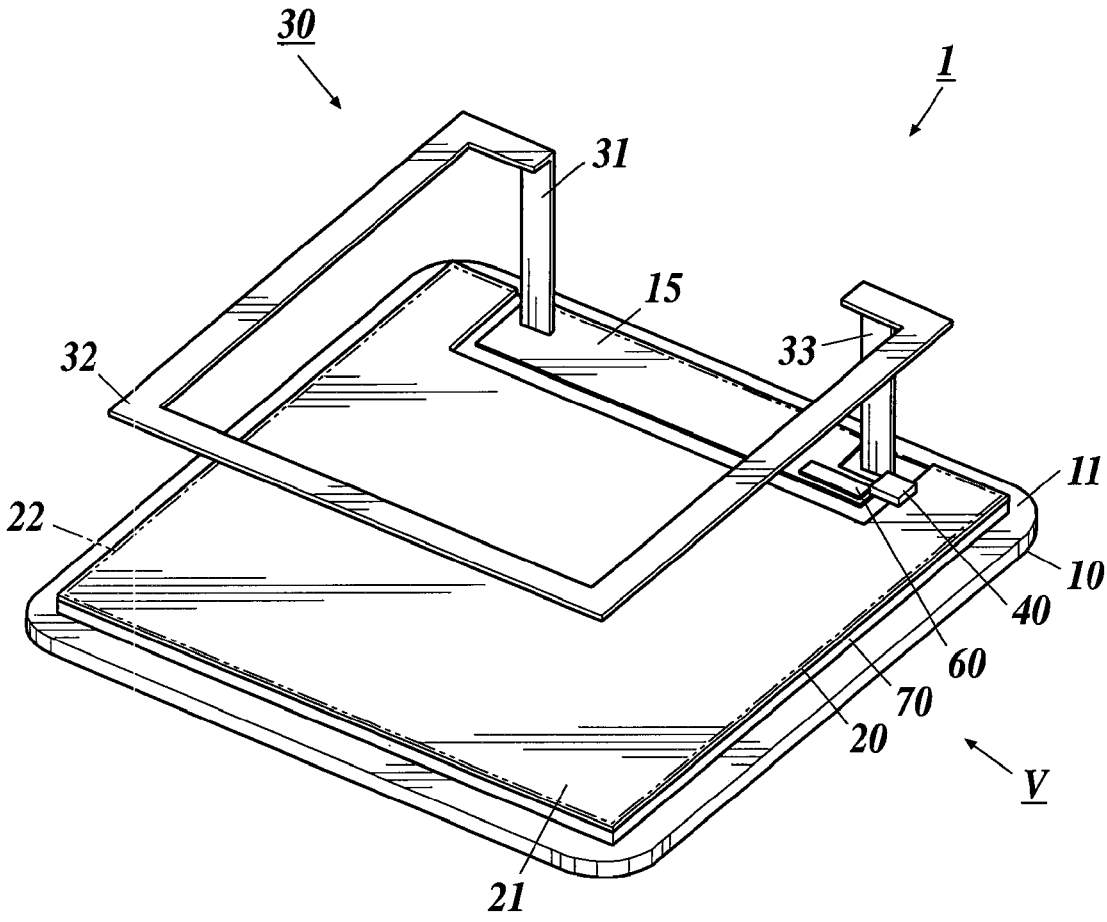
FIG. 1 is a perspective view of an antenna device 1 according to an embodiment of the present invention.
Figure 2:
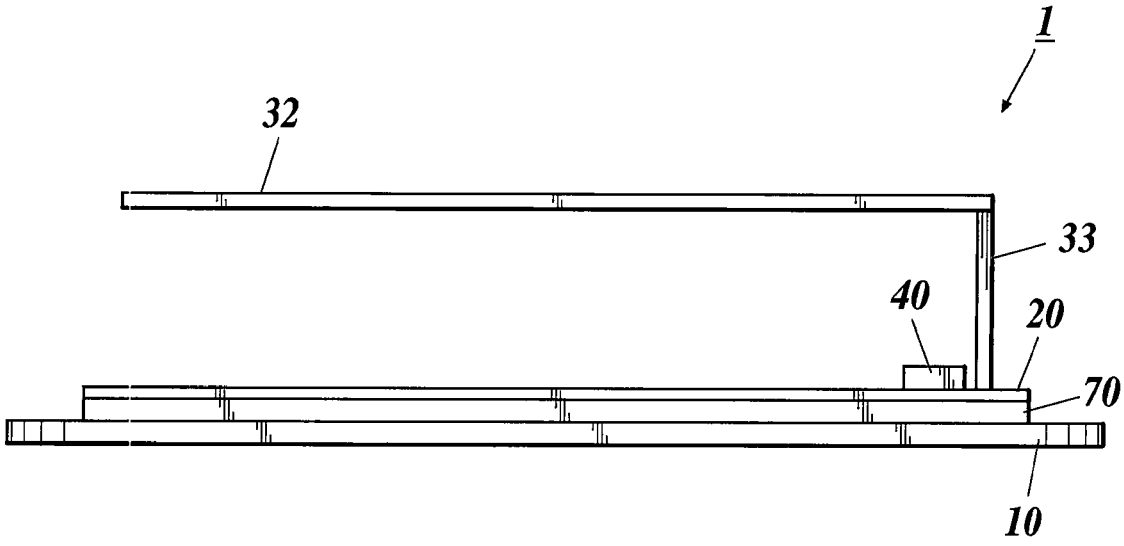
FIG. 2 is a side view of the antenna device 1 viewed from the direction of an arrow V shown in FIG. 1.

FIG. 1 shows a perspective view of an antenna device 1 according to an embodiment of the present invention. FIG. 2 shows a side view of the antenna device 1 viewed from the direction of the arrow V shown in FIG. 1.

The antenna device 1 is equipped with a ground plate 10, a ground pattern 15, a first feeding element 20, a second feeding element 30, a balun 40, a feeding section 50 (see FIG. 3), a matching circuit 60, and a substrate 70.

The ground plate 10 is a plate-like member whose material is a conductor and which has a planar section (for example, a planar section 11 on the substrate 70 side). The ground plate 10 functions as a ground section forming an equipotential surface. The ground plate 10 of the embodiment is a square plate as shown in FIG. 1, and one side thereof has a length of about 60 mm.

The ground pattern 15 is a rectangular plate whose material is a conductor and whose size is smaller than the ground plate 10. The ground pattern 15 is placed in a vicinity of one of the four sides of the ground plate 10, and is electrically connected to the ground plate 10. In the embodiment, the ground pattern 15 is formed so that one surface of the ground pattern 15, on which an upright portion 31 is formed, is parallel to the planar section 11 of the ground plate 10.

The first feeding element 20 is a plate-like feeding element which has a plane portion 21 arranged along the planar section 11 of the ground plate 10 with the substrate 70 put between them, as shown in FIGS. 1 and 2. The first feeding element 20 is electrically connected to the ground pattern 15 through the balun 40.

The second feeding element 30 is a circular feeding element including a loop-like body portion 32 which is arranged parallel to the first feeding element 20 at a predetermined distance therefrom, and functions as an antenna element for signal reception. The loop-like body portion 32 in the embodiment forms a substantially square loop as shown in FIG. 1. An area within a region 22 enclosed with an outer periphery of the plane portion 21 of the first feeding element 20 is larger than or equal to an area within a region enclosed with the loop-like body portion 32 of the second feeding element 30.

The second feeding element 30 includes the upright portion 31 on the one end side of the loop-like body portion 32 and an upright portion 33 on the other end side thereof with the loop-like body portion 32 put between them.

The upright portion 31 is formed by bending one end portion of the loop-like body portion 32 into a hook and is electrically connected to the ground pattern 15. Thus, the second feeding element 30 is grounded to the ground plate 10 through the ground pattern 15.

The upright portion 33 is formed by bending the other end portion of the loop-like body portion 32 into a hook and is electrically connected to the feeding section 50. The upright portion 33 is electrically connected to the feeding section 50 through the balun 40 and the matching circuit 60.

Figure 3:
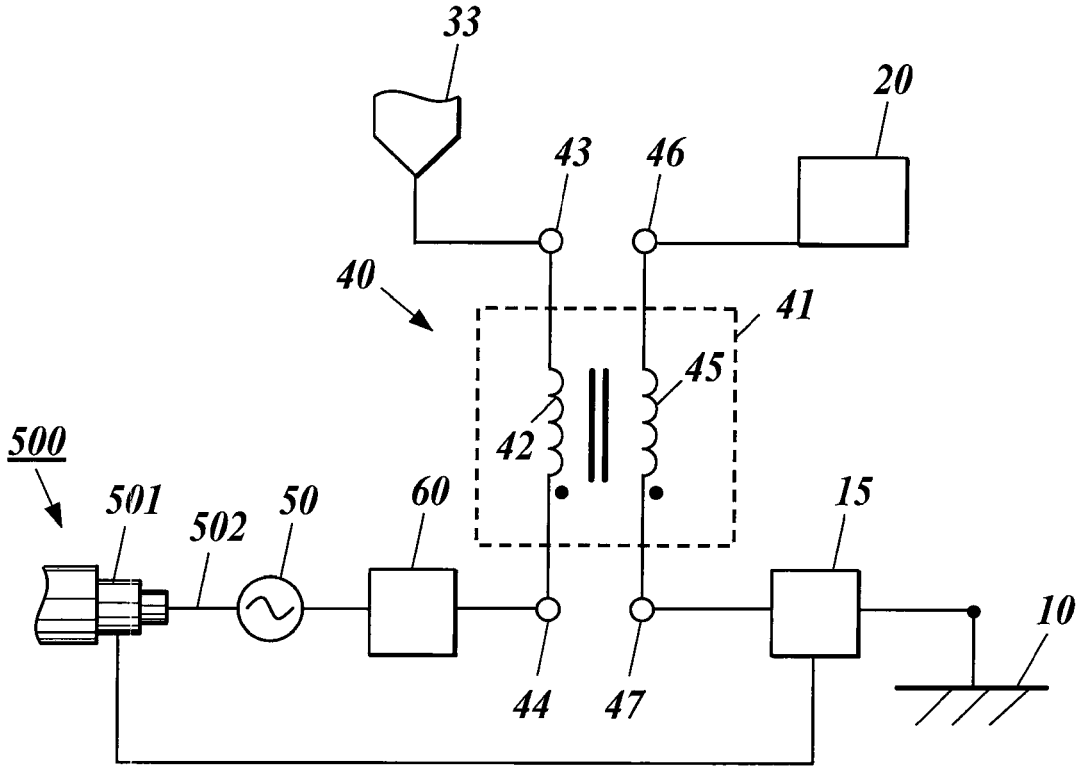
FIG. 3 is an explanatory diagram showing the connection state of each section of the antenna device 1.

FIG. 3 shows the connection state of each section of the antenna device 1.

The balun 40 includes a transformer 41. One end side 43 of a first winding 42 of the transformer 41 is electrically connected to one end side of the second feeding element 30. Although not especially shown in FIG. 3, the one end side 43 and the upright portion 33 are electrically connected to each other in the embodiment. Moreover, the other end side 44 of the first winding 42 is electrically connected to the feeding section 50 through the matching circuit 60. One end side 46 of a second winding 45 of the transformer 41 is electrically connected to the first feeding element 20. Then, the other end side 47 of the second winding 45 is electrically connected to the ground pattern 15.

As shown in FIG. 3 and the aforesaid description, the first feeding element 20 and the second feeding element 30 constitute a balanced type antenna pattern by connecting the first feeding element 20, the second feeding element 30, the feeding section 50, and the ground pattern 15 through the balun 40. The antenna device 1 performs balanced feeding with the first feeding element 20 and the second feeding element 30.

The feeding section 50 is a connecting section for connecting the antenna device 1 and a receiver using a radio wave received by the antenna device 1 (hereinafter simply referred to as "receiver"). The antenna device 1 and the receiver are connected to each other through a coaxial cable 500, for example. In this case, the coaxial cable 500 from the receiver is connected to the feeding section 50, an outside conductor 501 of the coaxial cable 500 is connected to the ground pattern 15, and a signal line 502 of the coaxial cable 500 is connected to the feeding section 50.

The matching circuit 60 performs impedance matching between the balun 40 and the feeding section 50. The matching circuit 60 intervenes between the balun 40 and the feeding section 50. The matching circuit 60 is grounded by being electrically connected to the ground plate 10 through the ground pattern 15.

Figure 4:
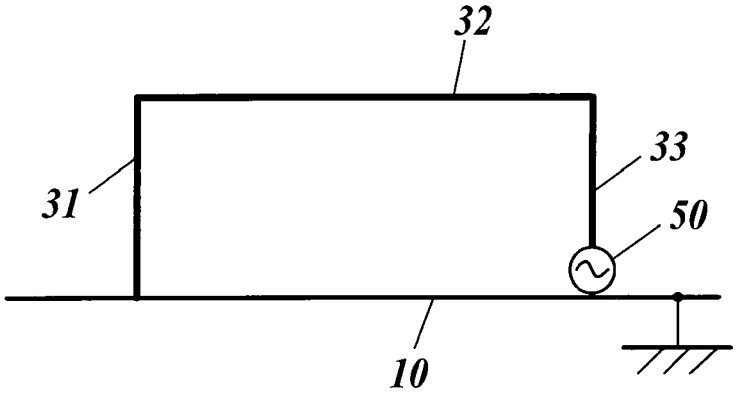
FIG. 4 is a diagram showing the principle of the antenna device 1.

FIG. 4 shows a diagram showing a principle of the antenna device 1.

As described above, the second feeding element 30 is connected to the ground plate 10 at the one end side, on which the upright portion 31 is provided, through the ground pattern 15. Then, the second feeding element 30 performs feeding with the feeding section 50 at the other end side, on which the upright portion 33 is provided, through the balun 40 and the matching circuit 60. Thus, as shown in FIG. 4, the second feeding element 30 is grounded at the one end side and performs feeding from the other end side.

The substrate 70 is a plate-like member for arranging the ground plate 10, the ground pattern 15, the first feeding element 20, the second feeding element 30, the balun 40, the feeding section 50, and the matching circuit 60 thereon. As shown in FIGS. 1 and 2, the ground pattern 15, the first feeding element 20, the second feeding element 30, the balun 40, the feeding section 50, and the matching circuit 60 are arranged on one surface of the substrate 70, and the ground plate 10 abuts against the other surface of the substrate 70.

The antenna device 1 of the embodiment is used for receiving vertically polarized waves having wavelengths in an 800 MHz band.

In the conventional antenna device, a minimum required size of the ground plate with respect to the wavelengths in the 800 MHz band is about 100 mm×about 100 mm when the ground plate is a square. It is sometimes difficult to install the ground plate of such size in the transportation machine such as the automobile. Even if installing the ground plate in the transportation machine is possible, the design of the transportation machine such as the automobile is sometimes limited. If the ground plate is simply downsized to meet area constraints so as to be easily installed in the transportation machine such as the automobile, the leakage current becomes large and the properties of the antenna device becomes unstable, and the antenna device cannot sometimes obtain a sufficient gain. The ground plate 10 of the embodiment has a square shape including the side of about 60 mm as described above, and its area is smaller than the area of the ground plate necessary for the wavelengths in the 800 MHz band.

For the above reason, the embodiment arranges both of the one end side and the other end side of the second feeding element 30 in the vicinity of the outer periphery of the ground plate 10. The antenna device 1 hereby can reduce the leakage current and can stabilize the properties thereof to make it possible to obtain a sufficient gain. In the following, a technical effect of the present invention will be described in detail.

When the antenna device 1 receives a radio wave, an electric current occurs in the second feeding element 30. The electric current is especially generated to the maximum quantity at two portions of the second feeding element 30, namely a standing portion of the second feeding element 30 which stands on the ground plate 10 and a standing portion on the other side of the second feeding section 30 which is connected to the feeding section 50. In the case of this embodiment, the electric current is generated to the maximum quantity at the two portions of the upright portion 31 and the upright portion 33.

When the electric current occurs in the second feeding element 30, an electric current variation is caused also in the ground plate 10.

If the electric current variation was caused in the whole of the ground plate 10, a large leakage current would be distributed in the outer conductor 501 of the coaxial cable 500 connected to the feeding section 50. As a result, the properties of the antenna device 1 vary owing to the length and/or the drawing-around of the coaxial cable 500, and the properties sometimes become unstable. Although the influences owing to the leakage current can be reduced if the area of the ground plate 10 is sufficiently large with respect to the wavelengths of radio waves, the size of the ground plate 10 is small with respect to the wavelengths of the radio waves in the embodiment. If the embodiment adopted the same configuration as the conventional antenna device, the configuration would be greatly influenced by the leakage current.

The embodiment therefore arranges both of the one end side and the other end side of the second feeding element 30 in the vicinity of one of the four sides of the ground plate 10. By this configuration, the electric current variation due to the electric current generated in the second feeding element 30 can be generated limitedly only on one side of the ground plate 10. In other words, it becomes possible to prevent the electric current variation from occurring in the whole of the ground plate 10. Thus, the distribution of the electric current leaking to the outer conductor 501 of the coaxial cable 500 connected to the feeding section 50 can be reduced. The reduction of the distribution of the electric current leaking to the outer conductor 501 of the coaxial cable 500 reduces the influences to the properties of the antenna device 1 owing to the length and the drawing-around of the coaxial cable 500. Thus, by arranging the both of the one end side and the other end side of the second feeding element 30 in the vicinity of one same side of the four sides of the ground plate 10, it becomes possible to provide the antenna device 1 having stabilized properties with very few influences caused by the length and the drawing-around of the coaxial cable 500 between the antenna device 1 and the receiver.

To put it concretely, as shown in FIG. 1, both of the upright portion 31 and the upright portion 33 are provided within the range of one surface of the ground pattern 15. By this configuration, the electric current variation in the case that the electric current is generated in the second feeding element 30 can be concentrated to the ground pattern 15, and thereby the distribution of a leakage current to the outer conductor 501 of the coaxial cable 500 connected to the feeding section 50 can be reduced. The antenna device 1 having stabilized properties can thus be provided.

Moreover, because the embodiment can prevent the electric current variation from occurring in the whole of the ground plate 10, an equipotential surface by the ground plate 10 can be stabilized. That is, the properties of the antenna device 1 including the ground plate 10 as the equipotential surface can be stabilized more.

Furthermore, because the embodiment performs balanced feeding by means of the first feeding element 20 and the second feeding element 30, the properties of the antenna device 1 can further be stabilized in comparison with the case of using the antenna pattern only with the second feeding element 30.

In addition, the element length of the second feeding element 30 in the embodiment is shorter than the wavelength of the radio wave received by the second feeding element 30. If the element length optimum for receiving the wavelength of the radio wave in the 800 MHz band is supposed to be $\lambda$, the length of the second feeding element 30 of the embodiment is $0.4\lambda$. By making the length of the second feeding element 30 shorter than the optimum element length for receiving the wavelength of the aimed radio wave (for example, wavelengths in the 800 MHz band), impedance mismatching is caused between the second feeding element 30 and the feeding section 50, but the impedance mismatching is corrected to be matched by the matching circuit 60.

Figure 5:
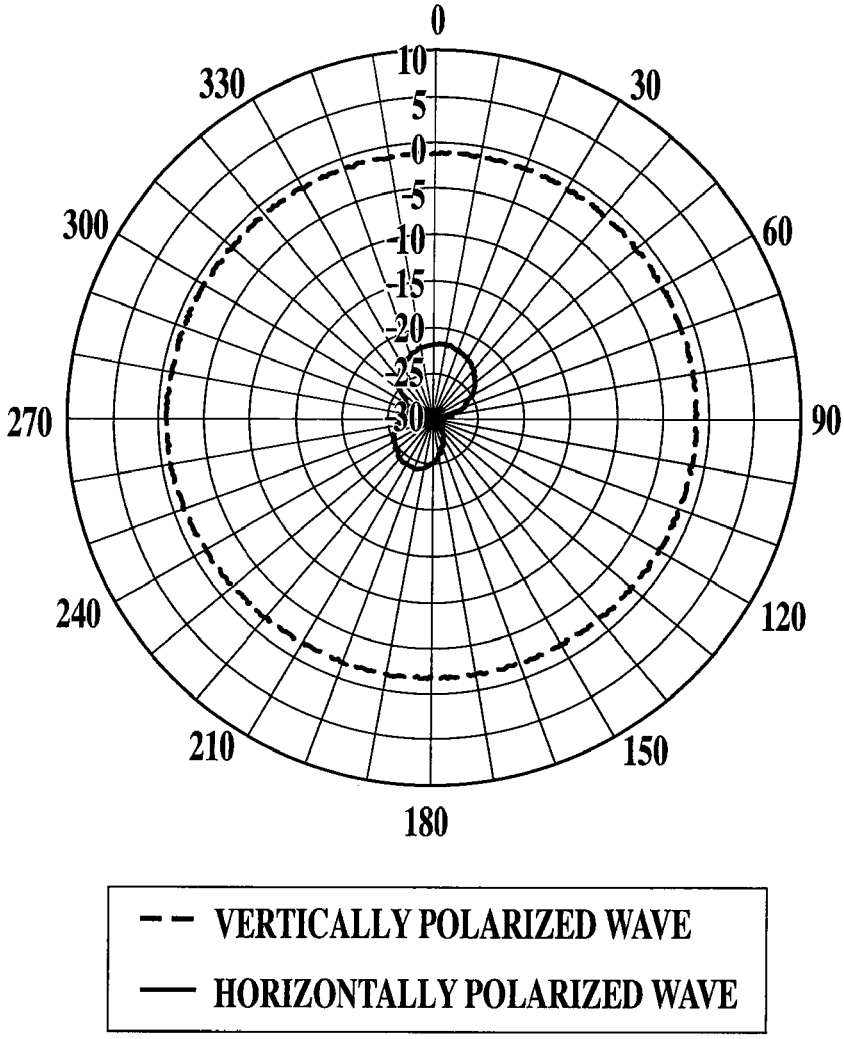
FIG. 5 is a directional property diagram of the antenna device 1.

FIG. 5 shows a directional property of the antenna device 1. The directional property shown in FIG. 5 is a horizontal pattern of the antenna device 1 with respect to the radio wave having the wavelength in the 800 MHz band.

As shown in FIG. 5, the antenna device 1 has a gain of a vertically polarized wave being larger than −3.0 db. In addition, a difference between the maximum value and the minimum value of the gain falls in a range of about 1.0 db. Thus, the antenna device 1 functions as a good non-directivity antenna which can achieve a high gain of a vertically polarized wave.

According to the embodiment, both of the one end and the other end of the second feeding element 30 are placed in the vicinity of the outer periphery of the ground plate 10. By this configuration, the electric current variation in the case that the electric current is generated in the second feeding element 30 can be concentrated to the ground pattern 15, and thereby the distribution of the leakage current to the outer conductor 501 of the coaxial cable 500 connected to the feeding section 50 can be reduced. As a result, the antenna device 1 having stabilized properties can be provided. For this reason, although the antenna device 1 uses the ground plate 10 of the size smaller than the size of the ground plate of the conventional antenna device necessary with respect to the wavelength of the aimed radio wave, the antenna device 1 has stabilized properties and can obtain a high gain. As shown in FIG. 5, the antenna device 1 functions as a good non-directivity antenna which can achieve a high gain of a vertically polarized wave. Thus, the antenna device 1 achieves all of a miniaturization of the antenna device 1, an obtainment of a high gain, and non-directivity of the antenna device.

Since the size of the antenna device 1 is small, the antenna device 1 can be easily provided in the inside of the transportation machine such as an automobile, and the antenna device 1 functions as a non-directivity antenna capable of obtaining a high gain.

Since the antenna device 1 performs balanced feeding by the first feeding element 20 and the second feeding element 30, the antenna device 1 can obtain more stabilized properties.

Moreover, the region 22 enclosed with the outer periphery of the first feeding element 20 sufficiently covers the region enclosed with the loop-like body portion 32 of the second feeding element 30. The properties of the antenna device 1 can be thereby more stabilized.

Furthermore, the length of the second feeding element 30 is shorter than the wavelength of the radio wave to be received, and the planar section 11 of the ground plate 10 is smaller than the area based on the wavelength of the radio wave to be received. The antenna device 1 can be thereby miniaturized.

Moreover, the first feeding element 20 and the second feeding element 30 are connected to each other through the balun 40. By this, performing balanced feeding by the first feeding element 20 and the second feeding element 30 becomes easy, and more stabilized properties can be obtained.

Furthermore, the antenna device 1 is equipped with the matching circuit 60 to perform the impedance matching between the balun 40 and the feeding section 50. The impedance mismatching caused between the second feeding element 30 and the feeding section 50 can be thereby corrected to be matched. The impedance mismatching between the second feeding element 30 and the feeding section 50 is caused when the length of the second feeding element 30 is shorter than the length depending on the wavelength of the radio wave to be received, and consequently the impedance mismatching would be produced in association with the miniaturization of the antenna device 1. However, by using the matching circuit 60, it becomes easy to miniaturize the antenna device 1.

Moreover, the length of the first feeding element depends on the wavelength of the radio wave in the 800 MHz band. By this, the antenna device 1 can be adopted as the antenna device for mobile telephone communication such as an internal telephone, in accordance with Global System for Mobile Communications (GSM) or the like.

In addition, all features of the embodiment of the present invention disclosed in the description should be interpreted as illustrative only and not in limiting sense. The scope of the present invention is not indicated by the aforesaid description but is indicated by the claims, and all changes having the equivalent meaning and being within the scope of claims are included therein.

Figure 6:
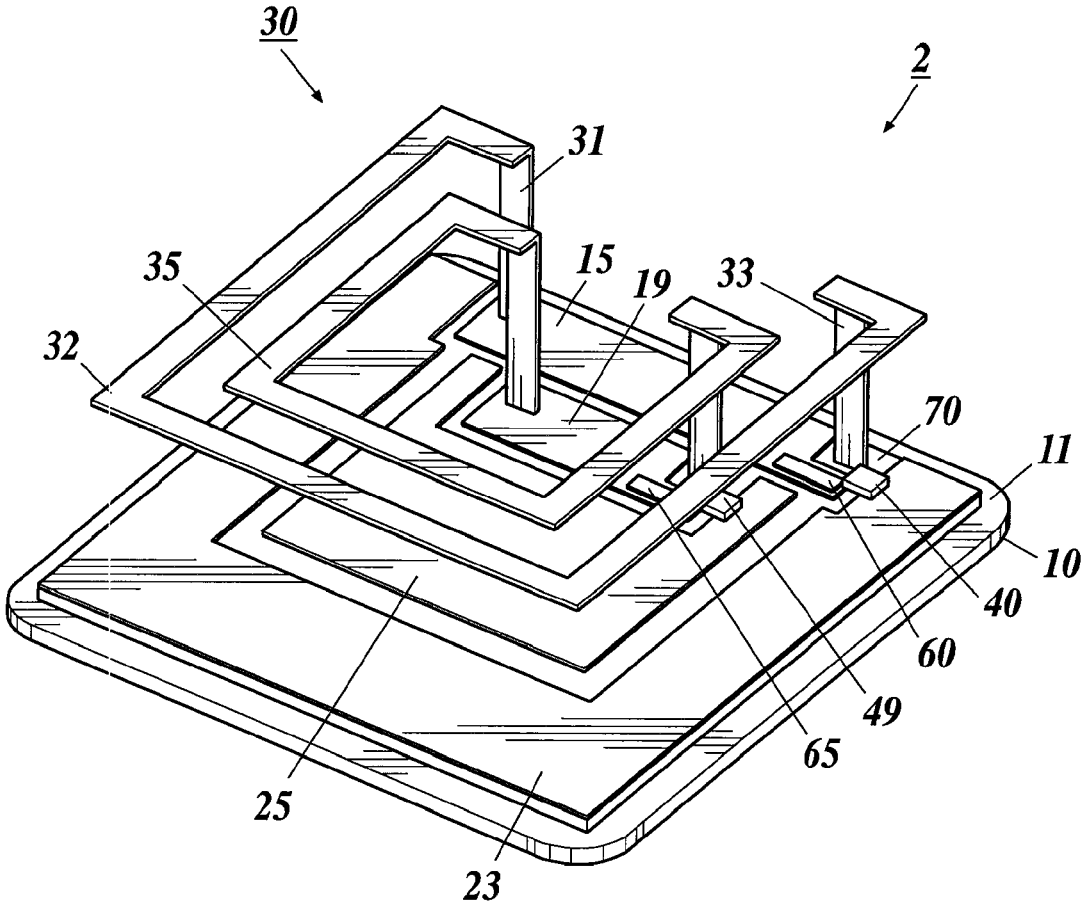
FIG. 6 is a perspective view of an antenna device 2 according to another embodiment of the present invention.
Figure 7:
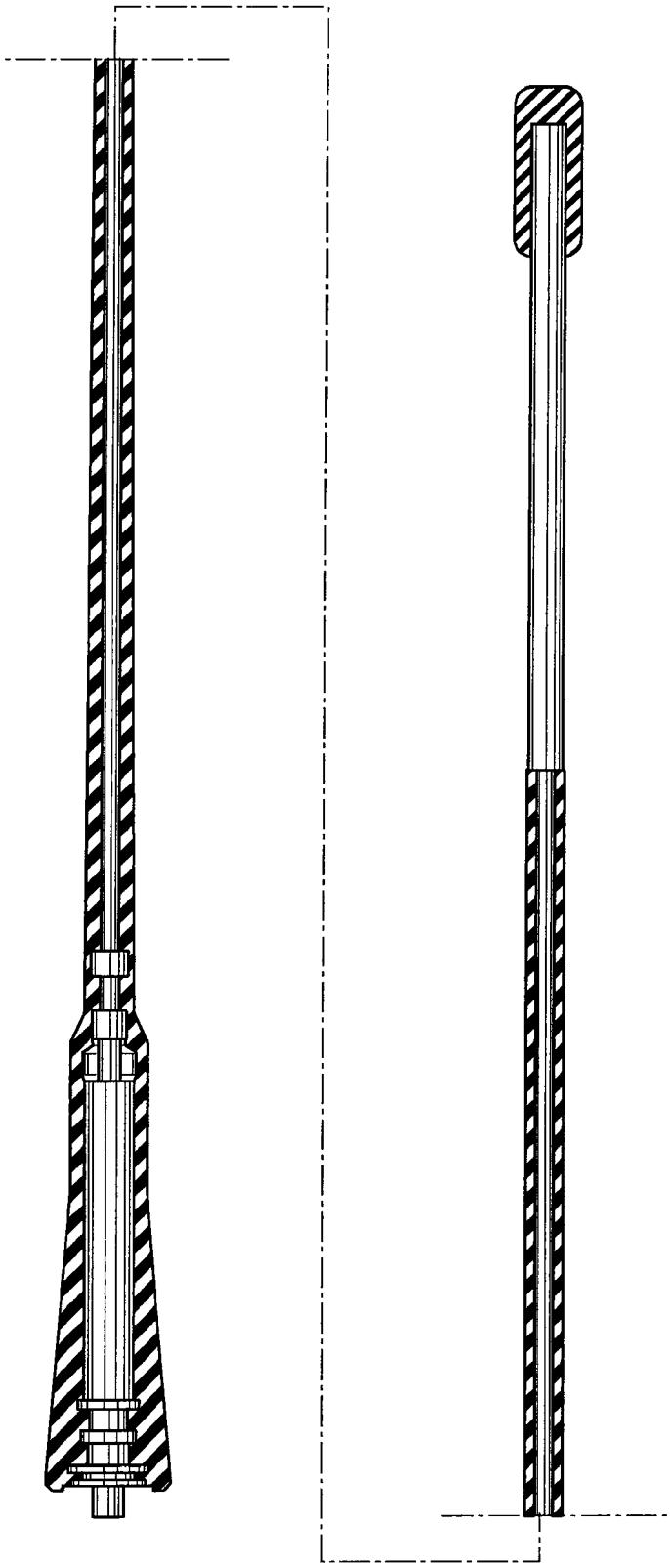
FIG. 7 is an explanatory diagram showing a conventional antenna device.

FIG. 6 shows a perspective view of an antenna device 2 according to another embodiment of the present invention.

The components of the antenna device 2 similar to those of the aforesaid antenna device 1 are denoted by the same signs, and their descriptions are omitted.

The antenna device 2 includes a ground pattern 19, a first feeding element 25, a second feeding element 35, a balun 49, and a second feeding section (not shown), and a matching circuit 65 in addition to the configuration of the antenna device 1. Thus, a plurality of first feeding elements and a plurality of second feeding elements are provided to the antenna device 2.

The second feeding element 35 has an element length based on the wavelength of the radio wave in a 1800 MHz band. If the element length optimum for receiving the radio wave having the wavelength in the 1800 MHz band is supposed to be Λ, the length of the second feeding element 35 of the antenna device 2 is 0.4Λ. As shown in FIG. 6, the second feeding element 35 is arranged within the inner periphery of the loop-like body portion 32 of the second feeding element 30. In this way, the respective lengths of the plurality of second feeding elements are different from each other.

The ground pattern 19, the first feeding element 25, the balun 49, and the matching circuit 65 are also provided so as to be located on the inner periphery side of the loop-like body portion 32 of the second feeding element 30.

A first feeding element 23 of the antenna device 2 is a frame-like feeding element including the first feeding element 25 which is provided within the inner periphery of the frame-like feeding element. The first feeding element 23 has the similar function to that of the first feeding element 20 of the antenna device 1.

The respective sizes of the first feeding element 25 and the second feeding element 35 and their arrangement relation, and the displacement of the ground pattern 19, the first feeding element 25, the second feeding element 35, the balun 49, the second feeding section, and the matching circuit 65 and their connection relation are similar to a relation among the ground plate 10, the ground pattern 15, the first feeding element 20, the second feeding element 30, the balun 40, the feeding section 50, and the matching circuit 60 of the antenna device 1. In other words, the first feeding element 25 and the second feeding element 35 are different from the first feeding element 20 and the second feeding element 30 of the antenna device 1 only in the sizes and the wavelength of the radio wave to be received, and the other functions of the first feeding element 25 and the second feeding element 35 are similar to those of the first feeding element 20 and the second feeding element 30.

According to the antenna device 2 of the other embodiment, it becomes possible to receive the radio waves in a plurality of frequency bands in addition to the advantages of the antenna device 1. The antenna device 2 can receive the radio wave in the 800 MHz band by the antenna pattern using the first feeding element 23 and the second feeding element 30, and further can receive the radio wave in the 1800 MHz band by the antenna pattern using the first feeding element 25 and the second feeding element 35. It is possible, hereby, to cope with the plurality of frequency bands adopted in GSM by one antenna device 2. Thus, it becomes possible to provide an antenna device capable of coping with a plurality of frequency bands without providing a plurality of antenna devices.

The shape of the loop-like body portion of the second feeding element is not limited to the square. For example, a quadrilateral other than the square and a polygon other than the quadrilateral may be adopted, and further a circle and an oval can be adopted.

The length of the second feeding element can be adjusted according to the wavelength of the radio wave to be received, and can cope with various wavelengths by the element lengths. Moreover, the element length may be changed owing to the existence of the matching circuit and the like even to the same frequency.

According to the embodiment, there is provided an antenna device including: a ground section including a planar section; a feeding section; a first feeding element arranged along the planar section of the ground section; and a second feeding element including a loop-like body portion arranged parallel to the first feeding element at a predetermined distance from the first feeding element, the loop-like body portion including one end portion bent to be electrically connected to the ground section, and the other end portion bent to be electrically connected to the feeding section, wherein both of the one end portion and the other end portion of the second feeding element are provided in a vicinity of an outer periphery of the ground section.

Preferably, balanced feeding is performed by the first feeding element and the second feeding element.

Preferably, an area of a region enclosed with an outer periphery of the first feeding element is equal to or more than an area of a region enclosed with the loop-like body portion of the second feeding element.

Preferably, a length of the second feeding element is shorter than a wavelength of a radio wave to be received by the second feeding element, and the ground section is a plate-like member which has an area smaller than an area based on the wavelength of the radio wave to be received by the second feeding element.

Preferably, the first feeding element and the second feeding element are connected to each other through a balun.

Preferably, the antenna device further includes a matching section to perform impedance matching between the balun and the feeding section.

Preferably, the first feeding element includes a plurality of first feeding elements and the second feeding element includes a plurality of second feeding elements, and the lengths of the respective second feeding elements are different from one another.

Preferably, a length of the second feeding element is based on a wavelength of a radio wave in any one of a 800 MHz band and 1800 MHz band.

According to the present invention, it becomes possible to achieve all of a miniaturization of the antenna device, an obtainment of a high gain, and non-directivity of the antenna device.

The entire disclosure of Japanese Patent Application No. 2009-227325 filed on 30 Sep. 2009, including specification, claims, drawings and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An antenna device, comprising:

a ground section including a planar section;

a feeding section;

a first feeding element arranged along the planar section of the ground section; and a second feeding element including a loop-like body portion arranged parallel to the first feeding element at a predetermined distance from the first feeding element, the loop-like body portion including one end portion bent to be electrically connected to the ground section, and another end portion bent to be electrically connected to the feeding section, wherein both of the one end portion and the another end portion of the second feeding element are provided in a vicinity of an outer periphery of the ground section; and wherein balanced feeding is performed by the first feeding element and the second feeding element.

2. The antenna device according to claim 1, wherein an area of a region enclosed within an outer periphery of the first feeding element is equal to or more than an area of a region enclosed within the loop-like body portion of the second feeding element.

3. The antenna device according to claim 1, wherein a length of the second feeding element is shorter than a wavelength of a radio wave to be received by the second feeding element, and the ground section is a plate-like member which has an area smaller than an area based on the wavelength of the radio wave to be received by the second feeding element.

4. The antenna device according to claim 1, wherein the first feeding element and the second feeding element are connected to each other through a balun.

5. The antenna device according to claim 4, further comprising a matching section to perform impedance matching between the balun and the feeding section.

6. The antenna device according to claim 1, wherein the first feeding element includes a plurality of first feeding elements and the second feeding element includes a plurality of second feeding elements, and lengths of the respective second feeding elements are different from one another.

7. The antenna device according to claim 1, wherein a length of the second feeding element is based on a wavelength of a radio wave in any one of a 800 MHz band and 1800 MHz band.

* * * * *